US012716403B2

(12) United States Patent
Kachkovskiy et al.

(10) Patent No.: US 12,716,403 B2
(45) Date of Patent: Aug. 25, 2026

(54) MULTI-PART SEALING ASSEMBLY

(71) Applicant: GD Energy Products, LLC, Tulsa, OK (US)

(72) Inventors: Vadim Kachkovskiy, Spring Mills, PA (US); Konner Casey Kay, Broken Arrow, OK (US); Adam Bradley Avey, Tulsa, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 342 days.

(21) Appl. No.: 17/954,040

(22) Filed: Sep. 27, 2022

(65) Prior Publication Data

US 2024/0102460 A1 Mar. 28, 2024

(51) Int. Cl.
*F04B 1/0448* (2020.01)

(52) U.S. Cl.
CPC ..... *F04B 1/0448* (2013.01)

(58) Field of Classification Search
CPC F04B 1/0448; F04B 53/22; F04B 53/16–164; F16K 5/0457–0485; E21B 43/2607
USPC ..... 277/323, 327, 342
See application file for complete search history.

(56) References Cited

U.S. PATENT DOCUMENTS 3,037,460 A * 6/1962 Guest ..... F04B 53/168 92/171.1
3,679,332 A * 7/1972 Yohpe ..... F04B 53/164 417/570
4,512,496 A * 4/1985 Tsou ..... F16J 13/10 220/240
4,730,835 A * 3/1988 Wilcox ..... E21B 33/1216 166/134
4,753,444 A * 6/1988 Jackson ..... E21B 33/1208 277/944
7,341,435 B2 * 3/2008 Vicars ..... F04B 53/16 417/454
10,094,376 B1 10/2018 Vicars
10,519,950 B2 * 12/2019 Foster ..... F16K 5/0271
10,539,132 B2 1/2020 Foster
10,837,556 B2 11/2020 Chase et al.
(Continued)

OTHER PUBLICATIONS

Peterson Products Company, Pipe Plugs and Packer for most size, pressure, chemical, and temperature requirements, available at https://www.petersenproducts.com/146-9-Series-Mechanical-Plugs-s/1909.htm, last accessed Sep. 27, 2022.
(Continued)

*Primary Examiner* — Alexander B Comley
(74) *Attorney, Agent, or Firm* — Edell, Shapiro & Finnan, LLC

(57) ABSTRACT

A sealing assembly for a fluid end of a reciprocating pump is installable within a segment of a casing of the fluid end and is arranged to form a seal with the segment. The sealing assembly includes a closure element and a seal element. The closure element has a sealing portion with a lateral surface that faces an interior wall of the segment of the fluid end. The seal element is sized to be installed around the closure element and includes a seal and one or more seal carriers. The seal is configured to form a seal between the lateral surface of the closure element and the interior wall of the segment. The one or more seal carriers are configured to position the seal with respect to the closure element.

20 Claims, 9 Drawing Sheets

(56) References Cited

U.S. PATENT DOCUMENTS

| | | | | |
|---|---|---|---|---|
| 10,914,171 | B2 | 2/2021 | Foster | |
| 11,105,328 | B2 | 8/2021 | Byrne | |
| 11,149,855 | B2 | 10/2021 | Guerra et al. | |
| 11,692,545 | B2 * | 7/2023 | Myers | F04B 53/1032 417/437 |
| 2007/0273105 | A1 * | 11/2007 | Stanton | F04B 53/164 277/500 |
| 2011/0189040 | A1 * | 8/2011 | Vicars | F04B 53/00 417/559 |
| 2016/0108910 | A1 * | 4/2016 | Smith | F04B 53/007 49/35 |
| 2019/0011051 | A1 * | 1/2019 | Yeung | F04B 53/10 |
| 2019/0063430 | A1 | 2/2019 | Byrne | |
| 2019/0360483 | A1 * | 11/2019 | Nowell | F04B 53/16 |
| 2020/0149528 | A1 | 5/2020 | Foster | |
| 2020/0300240 | A1 * | 9/2020 | Nowell | F16B 35/005 |
| 2020/0400130 | A1 | 12/2020 | Poehls et al. | |
| 2021/0156253 | A1 | 5/2021 | Foster | |
| 2021/0215154 | A1 * | 7/2021 | Nowell | F04B 1/16 |
| 2021/0355927 | A1 * | 11/2021 | Jian | F04B 39/10 |
| 2021/0388832 | A1 | 12/2021 | Byrne | |

OTHER PUBLICATIONS

Danco, Inc., PlugAll Test and Seal Plug, Dec. 17, 2021, available at https://www.youtube.com/watch?v=nDANzW5TJ2U, last accessed Sep. 27, 2022.

ESP Supply, 2" Torquer Locking Plug, Sch40, available at: https://www.shop-esp.com/2-Torquer-Locking-Plug-Sch40-P156.aspx?gclid=Cj0KCQiAqbyNBhC2ARIsALDwAsBYxsgOVsJPQz2Nli88qMbFwWcF4AyBVHtLbk2u080nmmagJicJFGUaAgfREALw_wcB, last accessed Sep. 27, 2022.

Extended European Search Report for European Patent Application No. 23199200.9, dated Dec. 19, 2023, 10 pages.

Communication Pursuant to Article 94(3) EPC for European Patent Application No. 23199200.9 from the European Patent Office dated Jul. 30, 2025, 5 pages.

* cited by examiner

MULTI-PART SEALING ASSEMBLY

FIELD OF INVENTION

The present invention relates to the field of high pressure reciprocating pumps and, in particular, to a sealing arrangement for fluid ends of high pressure reciprocating pumps.

BACKGROUND

High pressure reciprocating pumps are often used to deliver high pressure fluids during earth drilling operations. One or more sealing arrangements are typically provided in the fluid end to seal conduits formed in the fluid end and prevent, or at least discourage, leakage. More specifically, the fluid end may define an internal chamber and one or more conduits may define pathways between the internal chamber and one or more external surfaces of the fluid end. At least some segments of these conduits may be sealed with a sealing assembly (e.g., a cover, plug, and/or sleeve) that includes or defines one or more seals. These seals may prevent, or at least discourage, leakage through the conduits.

SUMMARY

The present application relates to techniques for sealing a segment of a fluid end of a high pressure reciprocating pump. The techniques may be embodied as a sealing assembly that is provided independent of any other elements or a sealing assembly that is incorporated in a fluid end and/or reciprocating pump. Additionally, the techniques may be embodied as a method for sealing a segment of a fluid end of a high pressure reciprocating pump.

More specifically, in accordance with at least one embodiment, the present application is directed to a sealing assembly for a fluid end of a reciprocating pump. The sealing assembly is installable within a segment of a casing of the fluid end and is arranged to seal the segment. The sealing assembly includes a closure element and a seal element. The closure element has a sealing portion with a lateral surface that faces an interior wall of the segment of the fluid end. The seal element is sized to be installed around the lateral surface of the closure element. The seal element includes a seal configured to form a seal between the lateral surface of the closure element and the interior wall of the segment and one or more seal carriers configured to position the seal with respect to the closure element. This is advantageous because it allows the seal element to be adjustably controlled and/or positioned.

In at least some embodiments, the seal is a compressible seal. Thus, the closure element can be tightened onto the seal to energize the seal and, if necessary, can be re-tightened over time to ensure the seal remains energized over time. Additionally, a compressible seal can be installed in a fluid end without generating a high amount of frictional resistance. Thus, a sealing assembly with a compressible seal may be easy to move in and out of a fluid end segment, especially as compared to sealing assemblies using conventional non-compressible seals (e.g., standard rubber seals) that closely conform to a fluid end segment and create a high amount of frictional resistance during installation or removal. As one example, the seal and the one or more seal carriers may comprise packing rings.

In at least some embodiments, the lateral surface is a grooveless surface. Among other advantages, this may reduce a number of wear points on the closure element. Additionally or alternatively, the closure element may have a main body that extends from an interior surface to an exterior surface, and at least a portion of the main body may have a non-circular cross-sectional shape. Among other advantages, this may allow the closure element to retain itself in a fluid end segment and/or to be positioned closer to the pumping chamber (realizing advantages of reducing the size of the pumping chamber).

Still further, in some embodiments, the closure element comprises a first body portion and a second body portion that sandwich the seal element when the sealing assembly is fully assembled. Thus, the sealing assembly might be able to be assembled prior to installation, while still realizing the installation advantages of the seal element. In some of these instances, the closure element includes a bolt that removably secures the first body portion to the second body portion. This bolt may allow adjustable tightening, both initially and over time. For example, when the seal is a compressible seal, the bolt may be operable to compress and energize the compressible seal, both during an initial installation and to compensate for wear over time. Additionally or alternatively, the aforementioned closure element may include one or more anti-rotation elements that prevent rotation of the first body portion with respect to the second body portion. These anti-rotation elements (e.g., pins) may secure the closure element in place during a tightening operation.

In some instances where the closure element comprises a first body portion and a second body portion, the lateral surface is defined by the first body portion and a retaining surface of the second body portion sandwiches the seal element against a shoulder of the first body portion. For example, the retaining surface of the second body portion and the shoulder may define an axially extending pocket. Alternatively, the lateral surface may be defined by the second body portion and a retaining surface of the first body portion may sandwich the seal element against a shoulder of the second body portion. For example, the retaining surface of the first body portion and the shoulder may define an axially extending pocket.

Still further, in some instances where the closure element comprises a first body portion and a second body portion, the first body portion includes a cavity, the second body portion includes a protrusion that extends into the cavity, and one or more seals are disposed between the protrusion and the cavity. Among other advantages, this may prevent, or at least discourage fluid from flowing between the body portions and causing wear. Additionally or alternatively, the closure element may extend from an interior surface defined by the second body portion to an exterior surface defined by the first body portion, and at least a portion of the closure element may have a non-circular cross-sectional shape.

BRIEF DESCRIPTION OF THE DRAWINGS

To complete the description and in order to provide for a better understanding of the present invention, a set of drawings is provided. The drawings form an integral part of the description and illustrate embodiments of the present invention, which should not be interpreted as restricting the scope of the invention, but just as examples of how the invention can be carried out. The drawings comprise the following figures.

Like reference numerals have been used to identify like elements throughout this disclosure.

DETAILED DESCRIPTION

Figure 1:
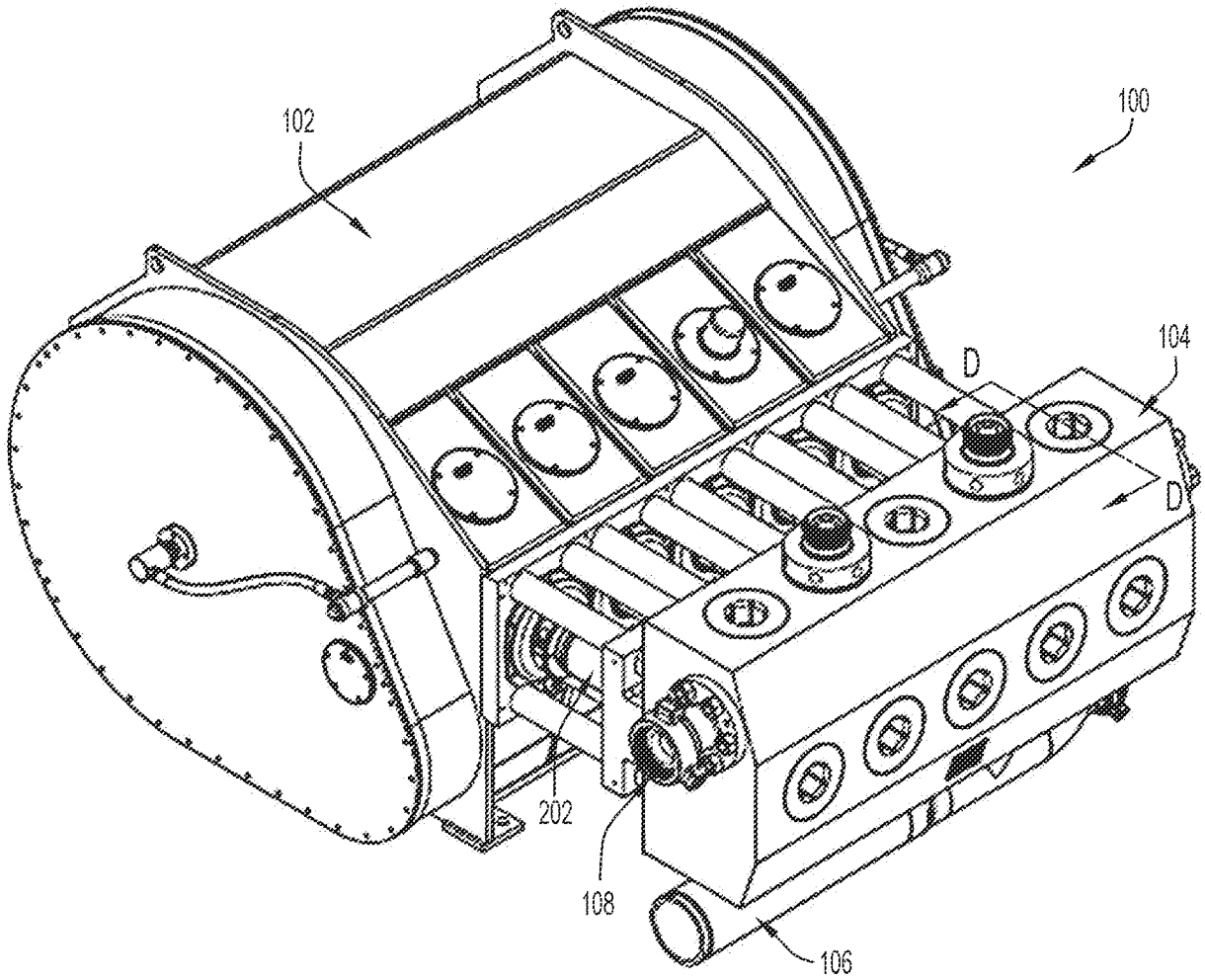
FIG. 1 is a perspective view of a reciprocating pump including a fluid end, according to an example embodiment.

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the sealing assembly presented herein provides an improved bore seal, at least as compared to conventional bore seals. The bore seal is improved because it is now adjustable and/or loadable (i.e., able to be preloaded). Moreover, the sealing assembly presented herein may be easier to install and/or remove from a fluid end because the sealing element may include a seal supported by seal carriers that may be installed in a fluid end segment separately from a closure element (e.g., a suction plug). For example, with the sealing assembly presented herein, a seal element can be installed into a fluid end bore segment before the closure element, eliminating the difficulties typically associated with installing a closure element that includes a seal that is tightly tolerance to a bore segment. In any case, during installation of the sealing assembly presented herein, an end user might not need to overcome the friction forces typically experienced during installation of a closure element with a traditional seal (e.g., a rubber, non-compressible seal) installed or included thereon.

In fact, in at least some embodiments, a seal included in the sealing assembly may be compressed and energized by the closure element of the sealing assembly to fully seal against a fluid end. Then, over time, further compression (e.g., generated via the user-controlled tightening of the closure element) can keep the seal energized. That is, in at least some embodiments the seal of the sealing assembly presented herein can be energized mechanically. In some instances, this mechanical energization may be generated by user-controlled tightening of one piece of a closure element against another piece of a closure element. Additionally or alternatively, a closure element may be tightened, by a user (e.g., via operation of a tool, machine, etc.), against the fluid end. In any case, the mechanical energization may expand the life of the seal, at least as compared to traditional, non-compressible/energizable seals (e.g., conventional rubber seals). In addition, a compressible/energizable seal may be formed from seal material that is less flexible than standard rubber seals. This may reduce seal movement, which, in turn, may reduce abrasion that causes wear and/or failure.

To be clear, the user-controlled tightening (as opposed to fluid-controlled tightening) may be important here. If the tightening were generated by fluid pressure emanating from the pumping chamber of a fluid end, the closure element may be overly tightened and may create metal-to-metal contact points that enhance wear. Also, if particulates within the fluid can travel between a flexing cover and a fluid end segment (as occurs in some designs that allow fluid pressure to compress a seal), the particulates may abrade the surface of the fluid end segment. Moreover, designs that allow fluid pressure to tighten a seal and cause seal expansion, are often quite complicated and require advanced machining operations that render the designs difficult and expensive to manufacture and maintain.

Now referring to FIG. 1 for a description of an exemplary embodiment of a reciprocating pump 100 in which the sealing assembly presented herein may be included. The reciprocating pump 100 includes a power end 102 and a fluid end 104. The power end 102 includes a crankshaft that drives a plurality of reciprocating plungers within the fluid end 104 to pump fluid at high pressure. Generally, the power end 102 is capable of generating forces sufficient to cause the fluid end 104 to deliver high pressure fluids to earth drilling operations. For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations.

Often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, especially typical "wear" components, and extend the time between maintenance operations (i.e., between downtime) are highly desirable.

Figure 2:
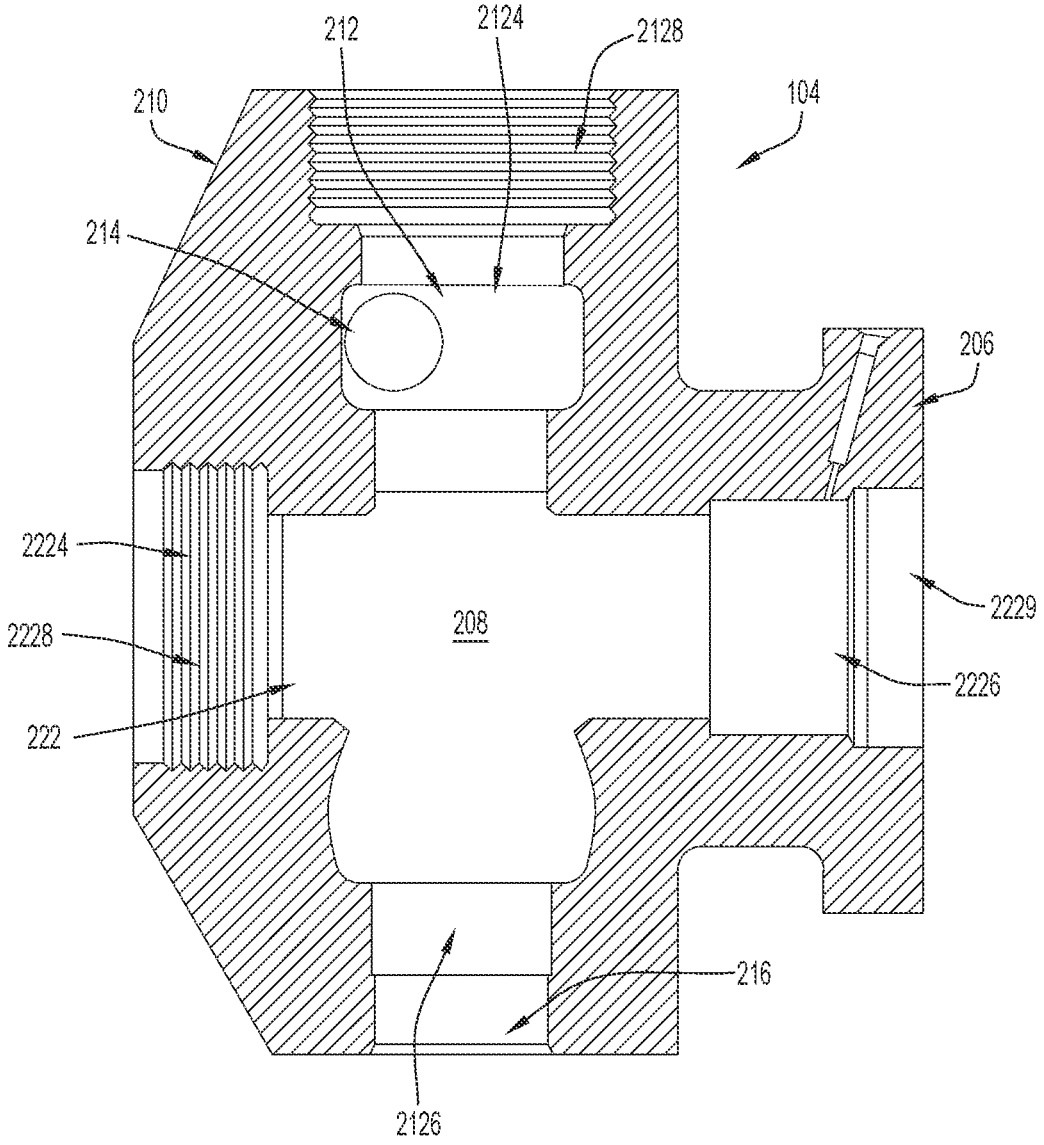
FIG. 2 is a cross sectional view taken along line D-D of FIG. 1.

FIG. 2 is a sectional view taken along line D-D of FIG. 1, which is representative of a central or plunger axis of one of the plungers 202 (see FIG. 1) included in reciprocating pump 100. In FIG. 2, the plunger 202 is omitted; however, generally, the fluid end 104 forms a plurality of pumping chambers 208 and each chamber 208 includes a plunger that reciprocates within a casing 206 of the fluid end 104. With each stroke of the plunger 202, low pressure fluid is drawn into the pumping chamber 208 and high pressure fluid is discharged. Often, the fluid within the pumping chamber 208 contains abrasive material (i.e., "debris") that can damage seals formed in the reciprocating pump 100.

The pumping paths and pumping chamber 208 of the fluid end 104 are formed by conduits that extend through the casing 206 to define openings at an external surface 210 of the casing 206. More specifically, a first conduit 212 extends longitudinally (e.g., vertically) through the casing 206 while a second conduit 222 extends laterally (e.g., horizontally) through the casing 206. Thus, conduit 212 intersects conduit 222 to at least partially define the pumping chamber 208. As is illustrated, the diameters of conduit 212 and conduit 222 may vary throughout the casing 206 so that the conduits can receive various structures, such as sealing assemblies or components thereof.

Regardless of the diameters of conduit 212 and conduit 222, each conduit may include two segments, each of which extend from the pumping chamber 208 to the external surface 210. Specifically, conduit 212 includes a first segment 2124 and a second segment 2126 that opposes the first segment 2124. Likewise, conduit 222 includes a third segment 2224 and a fourth segment 2226 that opposes the third segment 2224. In the depicted embodiment, the segments of a conduit (e.g., segments 2124 and 2126 or segments 2224 and 2226) are substantially coaxial while the segments of different conduits are substantially orthogonal. However, in other embodiments, segments 2124, 2126, 2224, and 2226 may be arranged along any desired angle or angles, for example, to intersect pumping chamber 208 at one or more non-straight angles and/or along non-coaxial paths.

Still referring to FIG. 2, in the depicted embodiment, conduit 212 defines a fluid path through the fluid end 104. Segment 2126 is an intake segment that connects the pumping chamber to piping delivering fluid to the fluid end 104. Meanwhile, segment 2124 is an outlet segment that allows compressed fluid to exit the fluid end 104. Thus, in operation, segments 2126 and 2124 may include valve components (e.g., one-way valves) that allow segments 2126 and 2124 to selectively open. However, typically, valve components in the inlet segment 2126 may be secured therein by piping while valve components in outlet segment 2124 may be secured therein by a sealing assembly that, for example, is secured to and seals against an interior wall of casing 206 defining segment 2124.

On the other hand, conduit 222 defines, at least in part, a cylinder for plunger 202, and/or connects the casing 206 to a cylinder for plunger 202. Thus, reciprocation of a plunger in or adjacent to segment 2226 draws fluid into the fluid chamber 208 via inlet segment 2126 and pumps the fluid out of the fluid chamber 208 via outlet segment 2124. Segment 2224 is an access segment that provides access to parts and surfaces disposed or defined within casing 206. However, in some embodiments, conduit 222 need not include segment 2224 and conduit 222 may be formed from a single segment (segment 2226) that extends from the pumping chamber 208 to the external surface 210.

Still referring to FIG. 2, but now in combination with FIG. 1, although FIG. 2 depicts a single pumping chamber 208, it should be understood that a fluid end 104 can include multiple pumping chambers 208 arranged side-by-side. In some embodiments, the fluid end 104 may be modular and different casing segments may house one or more pumping chambers 208. Additionally or alternatively, multiple pumping chambers 208 may be formed in a single casing segment or casing. Regardless of how the casing 206 is formed, the one or more pumping chambers 208 included therein are arranged side-by-side so that corresponding conduits are positioned adjacent each other and generate substantially parallel pumping action.

In operation, fluid may enter fluid end 104 via multiple openings, as represented by opening 216 in FIG. 2, and exit fluid end 104 via multiple openings, as represented by opening 214 in FIG. 2. In at least some embodiments, fluid enters openings 216 via pipes of a piping system 106 (see FIG. 1), flows through pumping chamber 208 (due to reciprocation of a plunger 202), and then flows through openings 214 into a channel 108 (see FIG. 1). However, piping system 106 and channel 108 are merely example conduits and, in various embodiments, fluid end 104 may receive and discharge fluid via any number of pipes and/or conduits, along pathways of any desirable size or shape.

During operations of pump 100, the first segment 2124 (of conduit 212), the third segment 2224 (of conduit 222), and the fourth segment 2226 (of conduit 222) may each be "closed" segments. By comparison, the second segment 2126 (of conduit 212) may be an "open" segment that allows fluid to flow from the external surface 210 to the pumping chamber 208. That is, for the purposes of this application, a "closed" segment may prevent, or at least substantially prevent, direct fluid flow between the pumping chamber 208 and the external surface 210 of the casing 206 while an "open" segment may allow fluid flow between the pumping chamber 208 and the external surface 210. To be clear, "direct fluid flow" requires flow along only the segment so that, for example, fluid flowing from pumping chamber 208 to the external surface 210 along segment 2124 and channel 108 does not flow directly to the external surface 210 via segment 2124.

Consequently, in operation, segment 2124, segment 2224, and segment 2226 may be each be completely capped, sealed, plugged, or otherwise closed to prevent fluid from passing through one of these segments to the external surface 210 of casing 206. In segment 2124 or segment 2224, this seal may be achieved with a plug-style or plug-type version of the sealing assembly presented herein. For simplicity, the Figures (e.g., FIGS. 5-8 and 10-12) only show a plug-style sealing assembly positioned in segment 2224, but segment 2124 may also receive any plug-style embodiment of the sealing assembly presented herein. In fact, in some instances, a sealing assembly disposed in segment 2124 may be referred to as a discharge plug and a sealing assembly disposed in segment 2224 may be referred to as a suction plug.

On the other hand, a sleeve-style/type version of the sealing assembly presented herein (i.e., a modified version of the sealing assembly 300 of FIG. 5) may be used to seal segment 2226. A sleeve-style sealing assembly may be an annular version of the sealing assembly presented herein. For example, although not shown herein, a sleeve-style sealing assembly may extend between casing 206 and a packing arrangement. Thus, in some instances, a sealing assembly disposed in segment 2226 may be referred to as a packing sleeve.

Still referring to FIG. 2, during setup/servicing of the fluid end 104, the sealing assembly presented herein may be inserted into segment 2124, segment 2224, and/or segment 2226. Then, retaining elements (not shown), such as lock members, retaining nuts, etc., may be installed exteriorly of each sealing assembly to secure the sealing assembly therein. In the embodiment depicted in FIG. 2, segment 2124, segment 2224, and segment 2226 include threads 2128, threads 2228, and threads 2229, respectively, disposed adjacent the external surface 210 of the casing 206. Thus, a retaining element may be threaded into place to secure the sealing assembly presented herein into segment 2124, segment 2224, or segment 2226.

However, in other embodiments, the sealing assembly presented herein may be secured in segment 2124, segment 2224, and/or segment 2226 via any desired techniques, e.g., with fasteners, pressure, and/or additional closure components, either in addition to or in lieu of threaded retaining elements, provided that the techniques allow the sealing assemblies presented herein to be removed for servicing and/or replacement, pursuant to the techniques detailed below. Moreover, the sealing assembly presented herein may be installed in segment 2124, segment 2224, and segment 2226 with the same or different techniques, structures, etc.; but, the sealing assemblies should each be removable from their segment to allow for replacement and/or servicing of the sealing assembly and/or components/parts sealed inside the casing 206 by the sealing assembly (e.g., one-way valves, the casing itself, etc.). As an example, in some embodiments, the sealing assembly presented herein may secure itself in a bore segment due to its non-circular shape.

Figure 3:
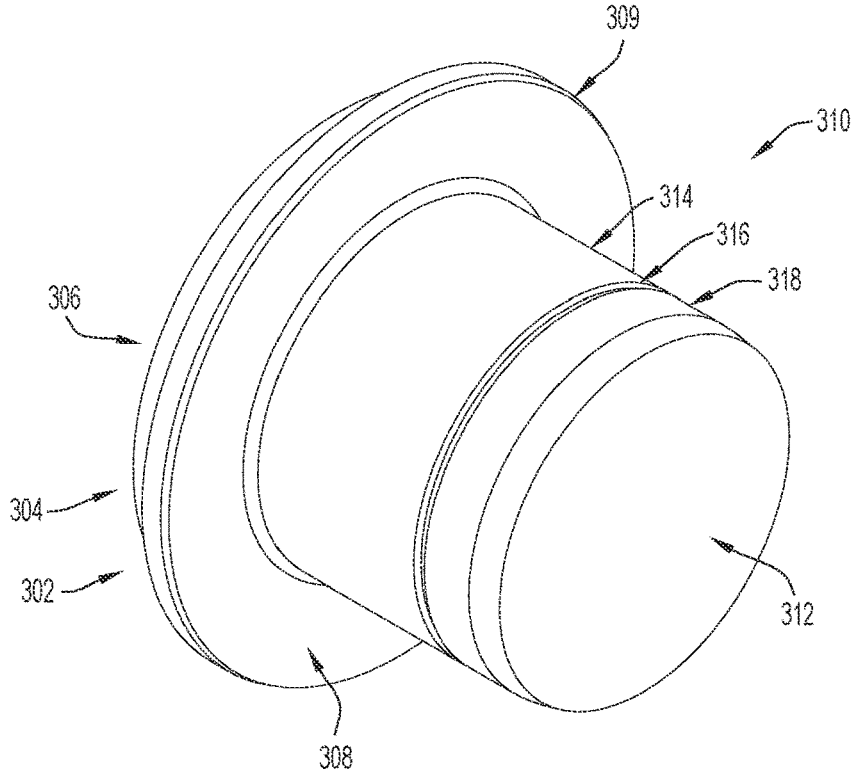
FIGS. 3 and 4 are perspective views of example closure elements for a fluid end that may be included in sealing assemblies of the present application.
Figure 4:
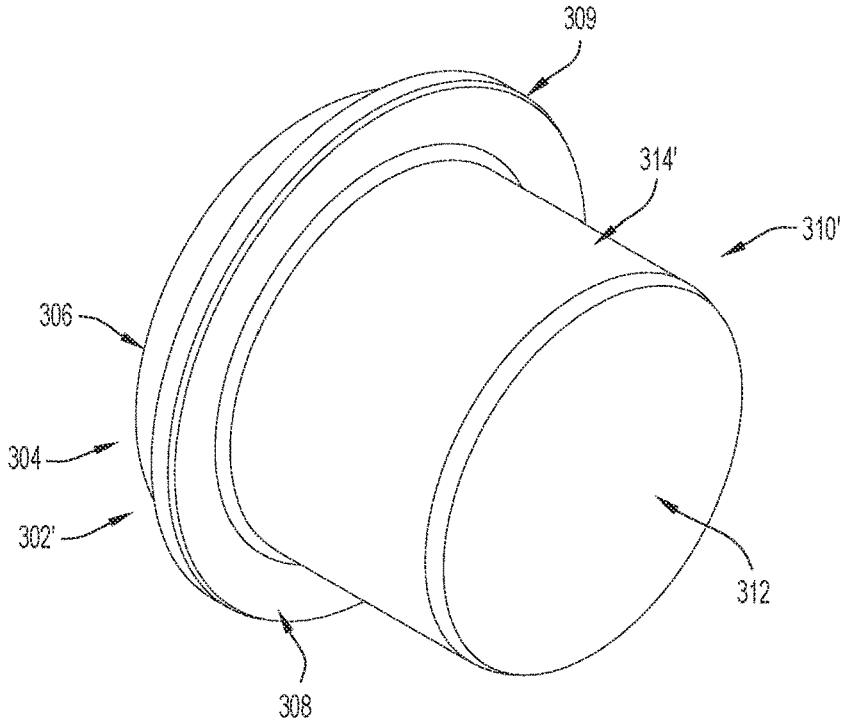
Figure 5:
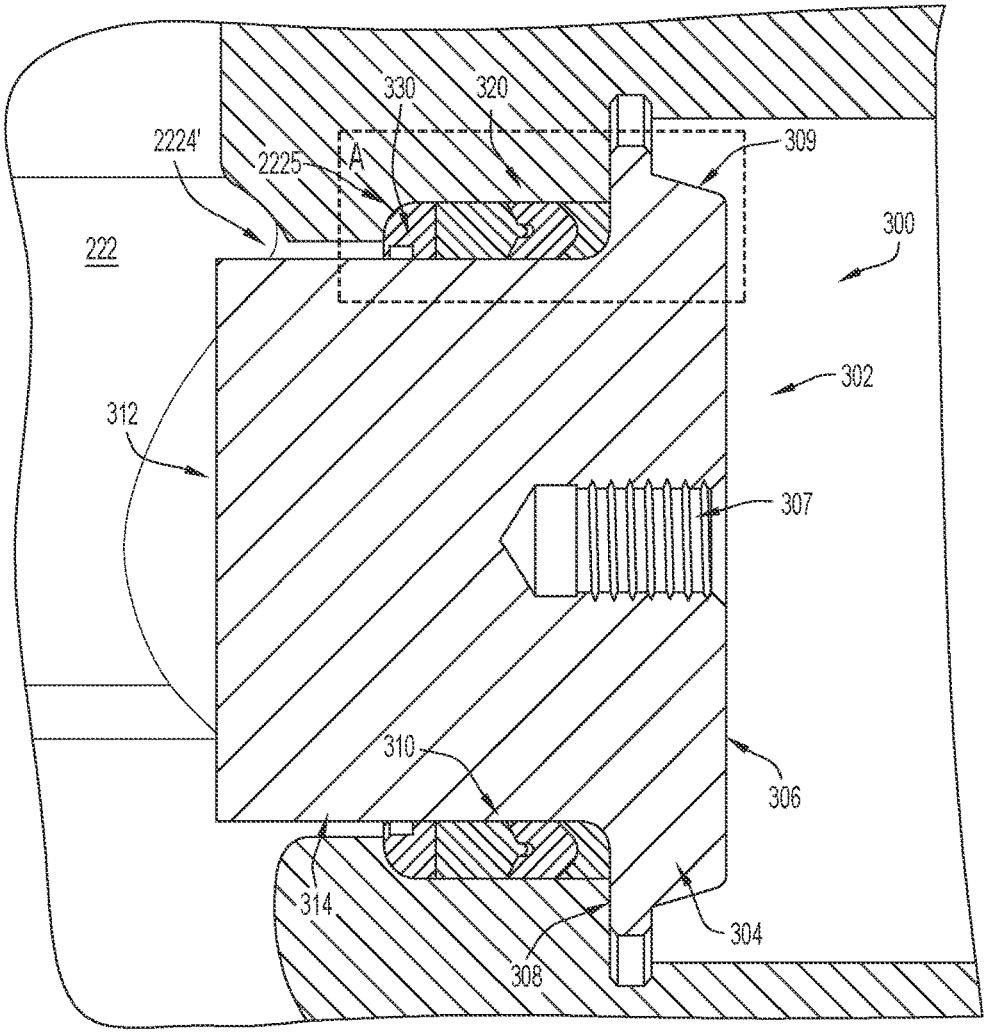
FIG. 5 is a schematic illustration of a sectional view of an example embodiment of a sealing assembly formed in accordance with the present application, the sealing assembly shown installed in an example embodiment of a fluid end.

Now turning to FIGS. 3, 4, and 5, the sealing assembly 300 presented herein includes a closure element, such as closure element 302 or closure element 302', and a seal element 320 (which may also be referred to as a seal subassembly 320). In FIGS. 3, 4, and 5, closure elements 302 and 302' are depicted as plugs, but, to reiterate, the closure element may also be in the form of a sleeve. In any case, closure elements 302 and 302', or variations thereof, each have a substantially circular, or at least substantially ovular, cross-sectional outer shape that is configured to substantially mate with a segment for which it is intended (e.g., segment 2124, segment 2224, or segment 2226).

Specifically, and now turning to FIG. 3, closure element 302 has a substantially circular sealing portion 310 that extends from a flange 304. The flange 304 extends from a top or proximal surface 306 to a bottom or distal surface 308 while overhanging the sealing portion 310. Thus, when the sealing assembly 300 is inserted into a segment (e.g., segment 2124, segment 2224, or segment 2226), the flange 304 may sit on a seat defined in or at the end of the segment, limiting axial displacement of the sealing assembly within a segment. In some embodiments, sealing assemblies may be specifically designed for specific segments, for example, by dimensioning flange 304 to engage a seat with a specific diameter/specific dimensions.

In some embodiments, the proximal surface 306 of the flange 304 includes a cavity 307 (see, e.g., FIG. 5) that may facilitate installation and/or create resilience for sealing. Additionally, in the depicted embodiments, an external radial surface (i.e., a side, outer surface) of flange 304 may be sloped or angled towards a radially extending lip 309 to encourage sealing and/or engagement with a retaining element (not shown). However, in various embodiments, the flange 304 may include any other features, in combination with one, none, or both of the cavity 307 and lip 309 for any desirable reason (e.g., sealing, installation, engagement with a retaining element, etc.).

Still referring to FIG. 3, the sealing portion 310 is generally configured to receive the seal element 320 so that the seal element 320 can form one or more seals against a casing segment within which the sealing assembly 300 is installed (e.g., segment 2124, segment 2224, or segment 2226). However, before discussing these features, it is important to understand the terms "upstream" and "downstream." Any fluid flow through casing 206 flows through pumping chamber 208 and may contact a bottom or distal end of a sealing assembly 300 that seals a segment (e.g., to prevent flow between the pumping chamber 208 and the external surface 210 of the casing 206). Thus, if a first component (e.g., a surface or portion) is described as being "upstream" of a second component (e.g., another surface or portion) the first component will be closer to the fluid flow (and high pressures associated therewith) than the second component (i.e., closer to pumping chamber 208). On the other hand, if a first component is described as being "downstream" of a second component, the first component will be closer to the external surface 210 of the casing 206 (and the relatively low pressures associated therewith) than the second component.

Now, as can be seen in FIG. 3, the sealing portion 310 extends from the distal surface 308 of the flange 304. In the depicted embodiments, the sealing portion 310 is substantially cylindrical, insofar as the term "substantially" indicates that edges of the cylinder (e.g., edges between a sidewall and a top/bottom) may be rounded, chamfered, or otherwise non-right angled. However, the sealing portion 310 need not be substantially cylindrical. In any case, the sealing portion 310 includes at least one lateral surface 314 on which the seal element 320 may be installed. In the embodiment depicted in FIG. 3, the lateral surface is grooveless, insofar as it does not include grooves or cavities configured to receive a seal, but it terminates at a notch 316 that is spaced from a distal surface 312 of the sealing portion 310. That is, the lateral surface 314 for the seal element 320 is a grooveless surface that extends over a portion of the sealing portion 310. Then, a secondary lateral surface 318 extends from the notch 316 to a distal surface 312 of the sealing portion 310 (which defines a distal end of the closure element 302). In the depicted embodiment, the secondary lateral surface 318 is also grooveless so that closure element 302 is entirely grooveless. In any case, overall, a main body of the closure element 302 extends from proximal surface 306 of the flange 304 to the distal surface 312 of the sealing portion 310.

In the depicted embodiment, the notch 316 is included in the sealing portion 310 so that the closure element 302 can receive and support a retaining ring 330 (see FIG. 3) that retains the seal element 320 on the lateral surface 314. The retaining ring 330 may be a snap ring that locks onto the notch 316, but this is just an example of a retaining feature and any other features, such as pins and/or threads could be used in combination with or in lieu of a retaining ring 330 secured onto notch 316 to axially secure a seal element 320 on the lateral surface 314 of the sealing portion 310. Retaining an upstream end of the seal element 320 may be advantageous because it may allow the seal element 320 to be installed in a gap between the closure element 302 and casing 206 without modifying the casing 206 and/or the closure element 302 (especially if a retaining feature, such as retaining ring 330, can be secured to the closure element 302 without a notch 316 or other such mating feature).

Now turning to FIG. 4, in at least some embodiments, the lateral surface of the sealing portion 310 (e.g., the surface on which the seal element 320 may be installed) extends to and terminates at or adjacent the distal surface 312 of the closure element 302. Thus, FIG. 4 depicts another embodiment of a closure element 302' that is similar to closure element 302, except for its sealing portion 310'. More specifically, closure element 302' has a flange 304 that is similar to (if not identical to) the flange of closure element 302, but the sealing portion 310' of closure element 302' does not include a notch 316 or a secondary lateral surface 318. Instead, the sealing portion 310' includes a grooveless lateral surface 314' that extends from the bottom or distal surface 308 of the flange 304 to the distal surface 312 of the closure element 302. Due the similarities between closure element 302 and closure element 302', any description of like parts should be understood to apply to both embodiments unless otherwise explicitly stated.

To be clear, closure element 302 and closure element 302' are merely two examples of closure elements that may be included in the sealing assembly 300 presented herein and other embodiments may include other variations. For example, a closure element suitable for the techniques presented herein may include a secondary lateral surface 318 that is shorter or longer than the secondary lateral surface 318 depicted in FIG. 3 (and it may be shorter or longer than lateral surface 314) and/or may include other features (e.g., in addition to or in lieu of notch 316). As further examples, other embodiments of closure elements are described below in connection with FIGS. 7-12. Still further, as mentioned, in at least some embodiments closure element 302 may be configured as a sleeve or plunger (an example of which is discussed below).

Now turning to FIG. 5, in some embodiments, regardless of the shape, size, or features of a closure element included in the sealing assembly presented herein, the closure element may compress and mechanically energize the seal element 320. This mechanical energization may cause one or more seals included in the seal element 320 to fully seal against the fluid end casing 206 (e.g., due to lateral expansion of the seal). When the sealing assembly 300 is formed with closure element 302 or closure element 302' (or other similar closure elements), this energization may be achieved by compressing the seal element 320 against a retaining ring 330 (which may, in some instances, be considered part of the seal subassembly 320). Additionally or alternatively, the seal element 320 may be compressed against a shoulder 2225 defined within a fluid end segment. FIG. 5 depicts shoulder 2225 within a segment 2224' that is a modified version of segment 2224, which is substantially straight (see FIG. 2). More specifically, when the sealing assembly 300 is formed with closure element 302 or closure element 302', the bottom or distal surface 308 of the closure element 302/302' may engage a downstream end of the seal element 320 and push/compress the seal element 320 towards its upstream end.

Figure 6:
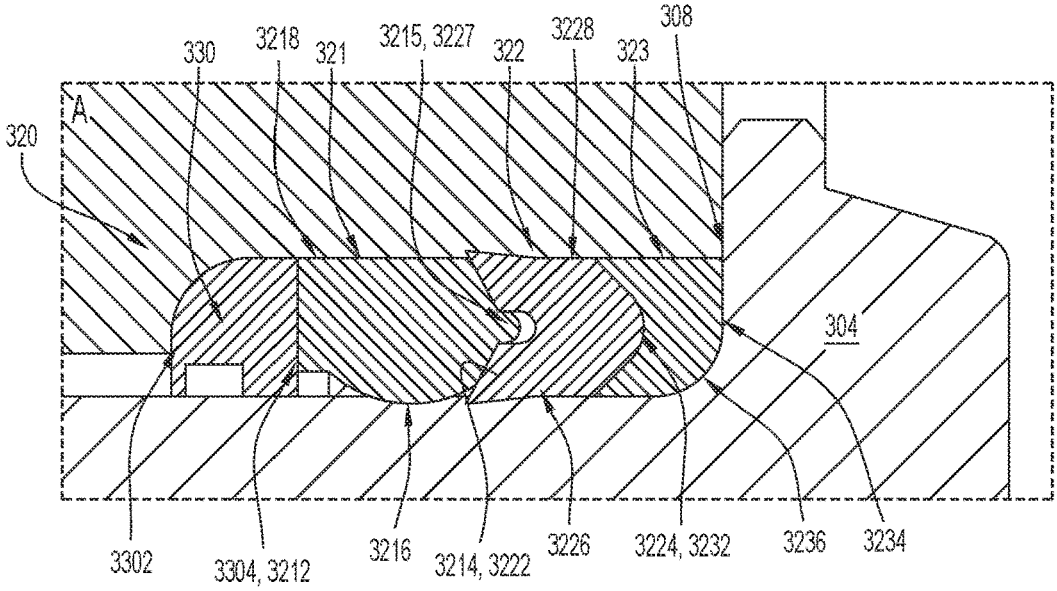
FIG. 6 is a close-up view of inset A of FIG. 5.

Now turning to FIG. 6, which provides a close-up view of inset A from FIG. 5, in at least some embodiments, the sealing assembly 300 presented herein may utilize energizable seals, such as reinforced, packing-style seals, that are more rigid than standard rubber seals and fully seal when compressed or otherwise energized. Consequently, the seal element 320 may comprise a set of packing rings, instead of one or more rubber seals. That is, for the purposes of this application, a set of packing rings may comprise a "seal element" or "seal subassembly." However, at the same time, certain portions of seal element 320 (e.g., certain packing rings) may be referred to as seal carriers while other portions of seal element 320 may be referred to as seals. The seal carriers may allow the seal to be precisely positioned along the lateral surface 314/314' of a closure element 302/302'. The seal carriers may also allow the sealing assembly to accommodate different types (e.g., shapes, sizes, materials, etc.) of seals. Put another way, the seal carriers may cause the sealing assembly to be adjustable.

As one example, in FIGS. 5 and 6, the seal element 320 includes a seal ring 321 or seal 321, a pressure ring 322, and a support ring 323. Each of rings 321, 322, and 323 is positioned downstream of the retaining ring 330, which may also be referred to as a junk ring 330 (and which, as mentioned, may be considered part of seal element 320 in at least some embodiments). However, in other embodiments, the seal element 320 (i.e., the packing arrangement) might include any combination of components arranged in any order. For example, an alternative embodiment might include any number and configuration of seal carriers—e.g., two or more pressure rings, any number of support rings, or other such rings. Moreover, the seal carriers may have suitable axial dimensions to collectively span the axial distance between the junk ring 330 and the distal surface 308 of the flange 304 (each of which might also have varied dimensions across different embodiments).

In the depicted embodiment, the junk ring 330 is the most upstream ring and, thus, is made of a hard material, such as steel. The junk ring 330 is annular in shape with a cylindrical inside surface and a cylindrical outside surface. However, the inner surface and outer surface may have radial (i.e., lateral) dimensions that are at least slightly smaller than the remaining components of the packing arrangement (e.g., seal ring 321, pressure ring 322, and support ring 323) to ensure that the hard material of the junk ring 330 has appropriate clearances between a casing segment and the closure element (e.g., between segment 2224' and closure element 302). At the same time, the radial dimensions of the junk ring 330 may be primarily selected to reduce the size of the gap between the casing 206 and the closure element 302 so that high pressure fluid acts on a smaller annular portion of a ring immediately downstream of the junk ring 330 (e.g., seal ring 321). In the depicted embodiment, the junk ring 330 also includes a stepped upstream surface 3302 (also referred to as a leading surface or lead surface) that abuts the shoulder 2225 defined by segment 2224'. Each stepped portion of the leading surface 3302 (see FIG. 4) is substantially flat or planar. Opposite the upstream surface 3302 is a substantially flat or planar downstream surface 3304.

Moving downstream, the seal ring 321 is also an annular ring that extends from an upstream end 3212 that abuts the retaining ring 330 to a downstream end 3214 that abuts the pressure ring 322. In the depicted embodiment, the upstream end 3212 is substantially planar while the downstream end 3214 includes a male chevron portion and a protrusion 3215 that extends towards (and potentially into) the pressure ring 322. However, in other embodiments, the downstream end 3214 and the upstream end 3212 may have any desirable shape or shapes. But, in at least some embodiments, the shape of the seal ring 321 may help the seal ring 321 seal against the closure element 302 and the interior wall of a segment, such as segment 2224'. For example, a lateral outer surface 3218 may be tapered outwards to seal against the interior wall of a segment, such as segment 2224' while the inner surface 3216 is at least partially outwardly bowed or convex to encourage a strong seal against lateral surface 314 of the closure element 302. However, these inner and outer surface shapes are merely examples and other embodiments may include any shaping that encourages or fosters sealing in response to axial compression (e.g., generated by the user-controlled tightening of closure element 302).

In some instances, the seal ring 321 may be substantially softer than other rings in seal element 320 (i.e., in the packing). Thus, in at least some embodiments, the seal ring 321 may form the primary seal for the seal element 320. This is why ring 321 may be referred to simply as a "seal" while the other rings may be referred to as "seal carriers." At the same time, the seal ring 321 may still be harder than traditional rubber seals and may be a compressible and/or energizable seal that seals against an interior wall of a fluid end segment when compressed.

Put another way, the seal ring 321 may be unbiased so that the seal ring 321 does not naturally shrink to a size that is smaller than the lateral surface 314 of the closure element 302. Instead, ring 321 may be compressible so that it can expand laterally and seal against adjacent lateral surfaces. Thus, the seal ring 321 need not be stretched and/or cut to be installed around the lateral surface 314 of the closure element 302 (which is typically required when a seal element 320 slips into a groove formed in a closure element). In fact, the seal element 320 of the present application can be installed into a fluid end segment independently—i.e., without the closure element 302, such as prior to the closure element 302. When this stretching and cutting is eliminated, the seal element 320 can be formed from harder materials (e.g., minimally stretchable) and/or can be a continuous, uncut element. For example, the seal element 320, or at least portions thereof, may have a hardness of at least Shore 60D.

Additionally or alternatively, the seal element 320, or at least portions thereof, could be made of different materials when the seal element 320 need not be stretched or cut (e.g., in addition to or instead of pure rubber), such as fiber-filled or fabric-reinforced constructions. For example, the seal ring 321 may be formed from homogeneous elastomers, filled elastomers, partially fabric reinforced elastomers, and full fabric reinforced elastomers. Suitable resilient elastomeric materials include, but are not limited to, thermoplastic polyurethane (TPU), thermoplastic copolyester (COPE), ethylene propylene diene monomer (EPDM), highly saturated nitrile rubber (HNBR), reinforced versions of the foregoing materials, such as versions reinforced with fibers or laminations of woven material, as well as combinations of any of the foregoing materials.

Still referring to FIG. 6, and still moving downstream, the pressure ring 322, which is one example of a seal carrier, is an annular ring that includes a tapered cylindrical inner surface 3226 that abuts the lateral surface 314 of the closure element 302 and a tapered cylindrical outer surface 3228 that abuts an interior wall of a casing segment, such as segment 2224. An upstream (high pressure) side 3222 of the pressure ring 322 includes a female chevron portion arranged to receive the male chevron portion of the seal ring 321. An aperture 3227 is formed in the female chevron portion and provides a relief space that allows the legs of the female chevron portion to flex inwards in response to compression (e.g., generated by the the user-controlled tightening of the closure element 302 into a fluid end segment). In at least some embodiments, the male chevron portion of the seal ring 321 and the female chevron portion of the pressure ring 322 have like dimensions and/or the aperture 3227 may receive the protrusion 3215 of the seal ring 321. In these instances, the downstream end 3214 of seal ring 321 matches or mirrors the upstream side 3222 of the pressure ring 322. However, the downstream end 3214 need not necessarily match or mirror the upstream side 3222.

Regardless of the dimensions, features, and/or characteristics of pressure ring 322, pressure ring 322 may bear the brunt of the pressure applied by the high pressure fluid within the pumping chamber 208. Therefore, the pressure ring 322 may be stiff or inflexible and lack springiness, at least as compared to the seal ring 321 (e.g., may have a hardness of at least Shore 65D). For example, in at least some embodiments, the pressure ring 322 is formed from an elastomer impregnated aramid fabric, but in other embodiments, pressure ring 322 may be formed from other suitable materials.

Finally, the support ring 323 may be an annular ring that is formed from the same or different materials than the pressure ring 322. The support ring 323 includes an inner surface 3236 that substantially conforms to a shoulder defined by/between the distal surface 308 of flange 304 and the lateral surface 314 of the closure element 302. Additionally, the support ring 323 extends from an upstream end 3232 that abuts the pressure ring 322 to a downstream end 3234 that abuts the distal surface 308 of flange 304. Thus, the support ring 323 essentially fills the axial space between the pressure ring 322 and the flange 304. In embodiments where the support ring 323 is formed from a material that is the same or similar to a material used to form the pressure ring 322, the support ring 323 and pressure ring 322 may collectively bear pressure bearing on the seal element 320. Alternatively, the support ring 323 might be formed from a harder material, such as a metal like aluminum, bronze, or an aluminum-bronze alloy to provide a hardened ring between the flange 304 and the pressure ring 322 (e.g., to at least partially control deformation of pressure ring 322 in response to compression). In either case, the support ring 323 is one example of a "seal carrier" in the present application.

Figure 7:
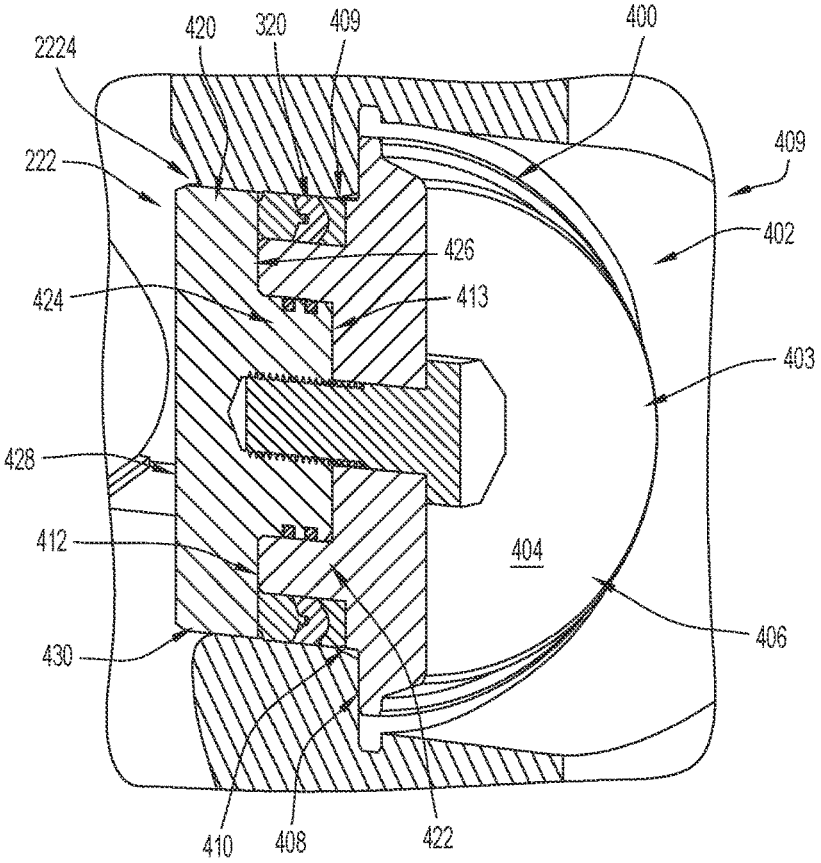
FIGS. 7 and 8 are schematic illustrations of sectional views of another example embodiment of a sealing assembly formed in accordance with the present application, the sealing assembly shown installed in an example embodiment of a fluid end.
Figure 8:
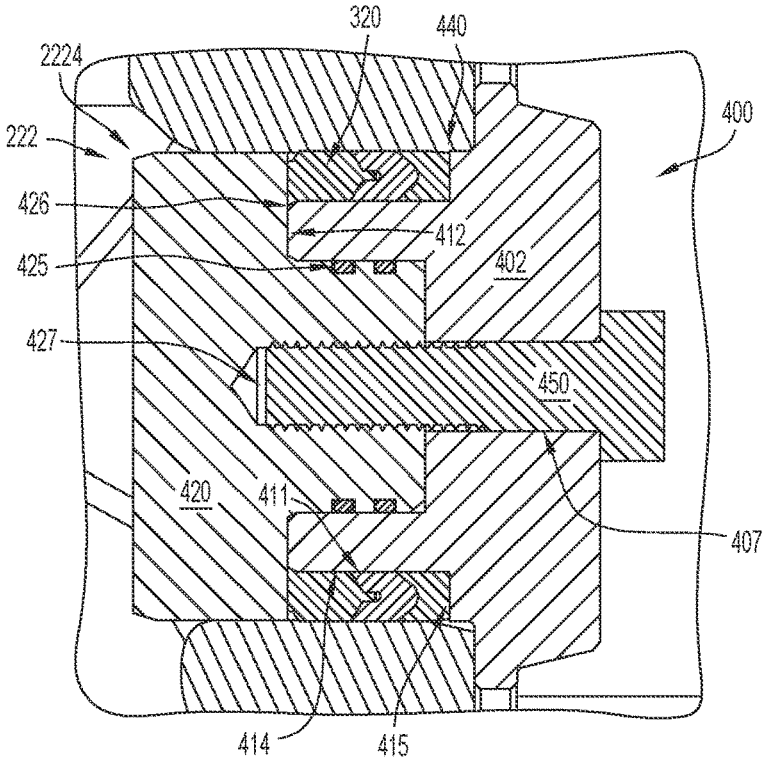
Figure 9:
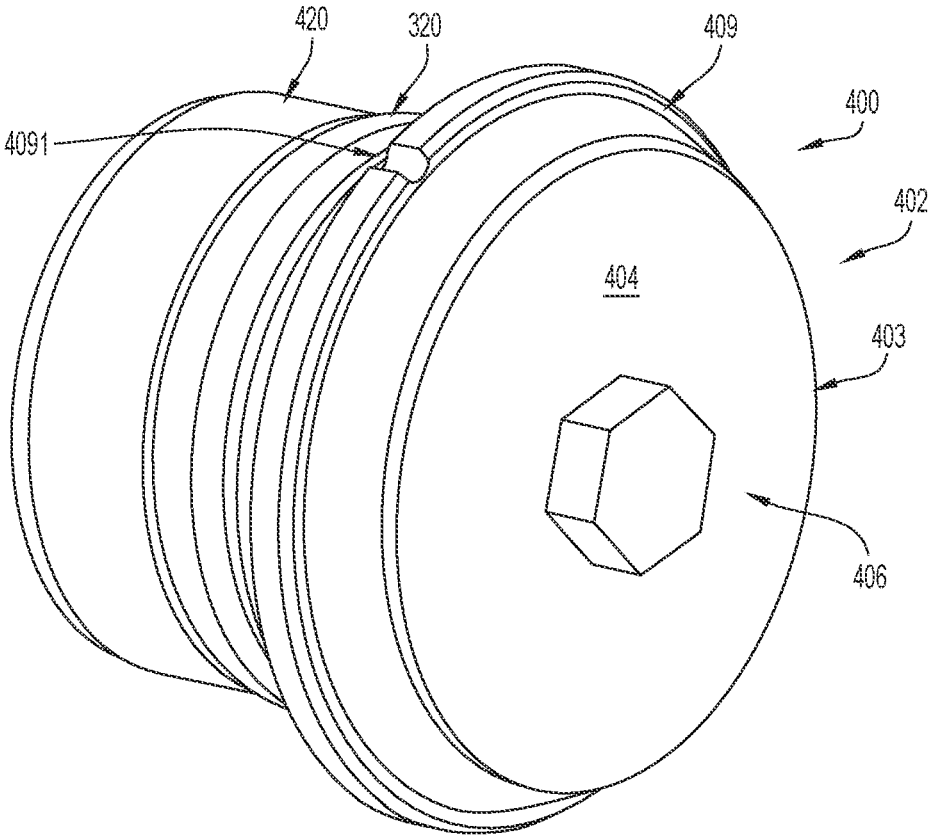
FIG. 9 is a perspective view of the sealing assembly of FIGS. 7 and 8.

Now turning to FIGS. 7-9, in some embodiments of the present application, a seal element 320 need not be sealed against a fluid end casing 206. Thus, FIGS. 7 and 8 each depict schematic, sectional views of an exemplary embodiment of a sealing assembly 400 including a multi-part closure element that sandwiches or encapsulates the seal element 320 and subsequently compresses the seal element 320. FIG. 9 depicts a perspective view of sealing assembly 400. Notably, in these Figures, the seal element is again depicted as seal element 320 and, thus, the prior description of seal element 320 should be understood to apply here. Generally, once the seal element 320 is installed within the two-piece closure element 402, a first body portion 403 can be tightened, by a user, against a second body portion 420 to compress a seal included in the seal element 320 (e.g., seal ring 321) and cause the seal assembly to form a tight, long-lasting seal between the closure element 302 and a fluid end segment, such as segment 2224. In fact, since the first body portion 403 tightens against the second body portion 420, segment 2224 can be entirely straight. Thus, the two-piece closure element 402 can be used to retrofit preexisting fluid ends with the sealing assembly presented herein (e.g., without requiring fluid end modifications that typically require advanced tooling and/or highly skilled workers).

In the depicted embodiment, the first body portion 403 and the second body portion 420 cooperate to form a closure element 402 that substantially resembles closure element 302'. Thus, the first body portion 403 defines a flange 404 that extends from top or proximal surface 406 to a bottom or distal surface 408. The flange 404 also includes a lip 409; however, instead of including a cavity, the first body portion 403 includes a hole 407 that extends thought the flange 404 and a sealing portion 410 of the first body portion 403. The sealing portion 410 defines a distal surface 412 of the first body portion 403 which, in the depicted embodiment, includes a cavity 413 that is substantially coaxial with the hole 407. Additionally, the sealing portion 410 includes a lateral surface 414 on which the seal element 320 can be installed. More specifically, in the depicted embodiment, the sealing portion 410 includes a step 411 and the lateral surface 414 is defined upstream of the step 411, between a radially extending surface 415 and the second body portion 420, as can be seen in FIG. 8.

The second body portion 420 has a lateral surface 430 that extends from a top or proximal surface 422 to a bottom or distal surface 428. The proximal surface 422 is configured to engage the distal surface 412 of the first body portion 403. More specifically, the proximal surface 422 includes a protrusion 424 that is substantially centered on a retaining surface 426. The protrusion 424 is sized and shaped to mate with the cavity 413 of the first body portion 403 and, in some embodiments, the protrusion 424 may include one or more traditional (e.g., conventional rubber) seals 425 configured to create a seal between the protrusion 424 and the cavity 413. Additionally or alternatively, in some instances, protrusion 424 and/or cavity 413 may be configured to prevent rotation of the first body portion 403 with respect to the second body portion 420 and vice versa. That is, in some instances, protrusion 424 and/or cavity 413 may be anti-rotation elements. However, other embodiments might include pins, cavities, or any other features to prevent rotation of the first body portion 403 with respect to the second body portion 420 and vice versa, either in addition to protrusion 424 and/or cavity 413 or in lieu of protrusion 424 and/or cavity 413.

Still further, in the depicted embodiment, the protrusion 424 includes a threaded cavity 427 configured to align with the hole 407 of the first body portion 403. Thus, the first body portion 403 and the second body portion 420 may be coupled together by installing a fastener 450 (e.g., a threaded bolt) through hole 407 and into threaded cavity 427. However, in other embodiments, the second body portion 420 need not include the aforementioned features and may couple to the first body portion 403 in any desirable manner.

Meanwhile, the retaining surface 426 is configured to define an upstream boundary for the seal element 320, so that the seal element 320 is sandwiched between the flange 404 and the retaining surface 426. Put another way, the retaining surface 426 and the flange 404 may define a pocket 440 in which the seal element 320 may be installed, e.g., prior to installing any components of the sealing assembly 400 in a bore segment. However, the seal element 320 need not be installed in the pocket 440 prior to installation of the closure element 302 in a fluid end segment. Instead, the sealing assembly 400 might be installed with at least three separate and distinct steps, with the second body portion 420 being inserted int a fluid end segment first, the seal element 320 being installed second (e.g., one ring at a time, or all together), and the first body portion 403 being installed in the fluid end segment last. Then, a fastener 450 may be passed through the first body portion 403 and coupled to the second body portion 420 to secure the first body portion 403 to the second body portion 420 while also compressing the seal element 320 to energize a seal (e.g., seal ring 321) included therein.

Now turning to FIG. 9, in at least some embodiments, the sealing assembly may include one or more anti-rotation elements 4091 that prevent rotation of the sealing assembly 400 with respect to a fluid end bore segment (e.g., segment 2224'). As one example, in FIG. 9, the lip 409 of the flange 404 of the first body portion 403 includes an anti-rotation element 4091 in the form of a notch. The notch 4091 is configured to engage a rod, post, or other protrusion on a fluid end to prevent rotation of the sealing assembly 400 when the sealing assembly is installed in a fluid end segment. However, to be clear, anti-rotation element 4091 is merely one example of such a feature disposed near the proximal surface 403 of the first body portion 403 of the sealing assembly 400. In other embodiments, such features may be disposed in any location on the sealing assembly, including on the second body portion 420.

Figure 10A:
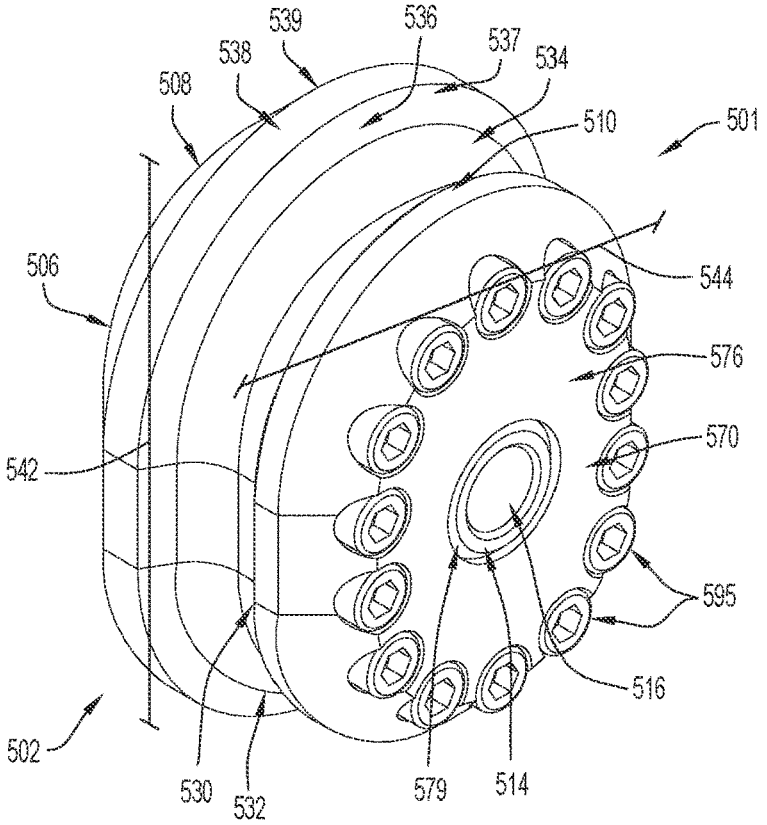
FIG. 10A is a perspective view of yet another example embodiment of a sealing assembly formed in accordance with the present application.
Figure 10B:
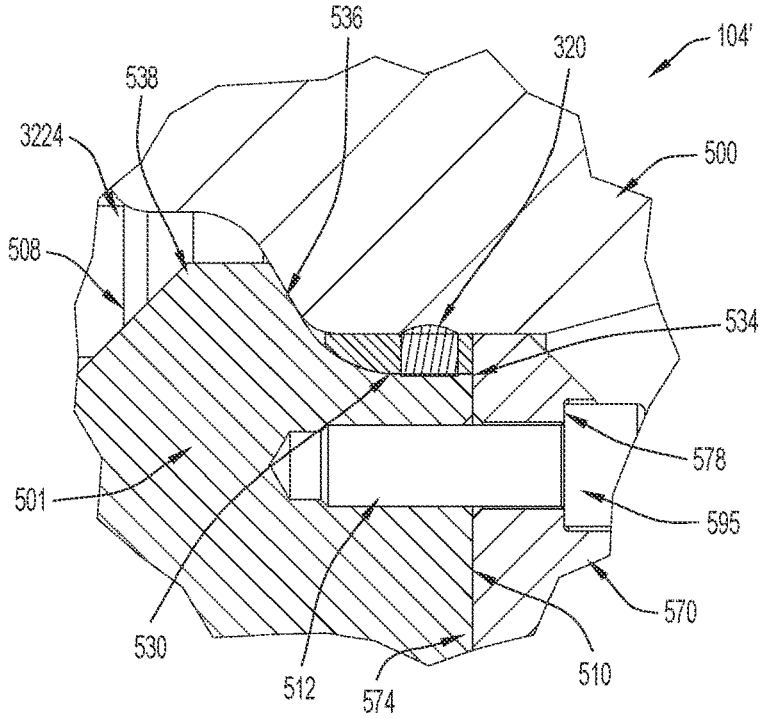
FIG. 10B is a schematic illustration of a sectional view of the sealing assembly of FIG. 10A while installed in an example embodiment of a fluid end.

Now turning to FIGS. 10A and 10B, which depict yet another embodiment of the sealing assembly presented herein, in at least some instances, the sealing assembly presented herein need not be circular. Instead, the sealing assembly may be substantially ovular, substantially stadium shaped, or otherwise non-circular. As one example, FIGS. 10A and 10B depict a non-circular embodiment sealing assembly 500 that includes a two-piece closure element 501 formed from a first body portion 502 and a second body portion 570. However, to be clear, a non-circular sealing assembly of the present application could also include a one-piece closure element or a closure element formed from three or more pieces could also be non-circular.

In the depicted embodiment, the first body portion 502 extends from an interior surface 506 to an exterior surface 510. When the first body portion 502 is installed in a non-circular segment 3224 (partially depicted in FIG. 10), the interior surface 506 is upstream of the exterior surface 510 (e.g., disposed closer to the pumping chamber 208 (see FIG. 2) than the exterior surface 510). In fact, in the particular embodiment of FIGS. 10A and 10B, the interior surface 506 of the first body portion 502 is disposed in or adjacent to the pumping chamber 208 when the first body portion 502 is installed in the non-circular segment 3224. This position may be advantageous not only because it allows the sealing assembly 500 to be secured in place without threads, but also because it reduces the overall size of the pumping chamber 208, which is typically advantageous when pumping compressible fluids (i.e., fluids for which the reciprocating pump 100 is intended). To help smooth pressure gradients across the interior surface 506 (e.g., created by fluid moving through the pumping chamber 208), the interior surface 506 may include tapered edges 508.

It is possible to install the first body portion 502 in or adjacent the pumping chamber 208 because the overall shape (e.g., the largest dimension) of the first body portion 502 is non-circular so that the first body portion 502 has an elongated overall dimension 542 and a narrow overall dimension 544 that is smaller than the elongated overall dimension 542. Dimensions 542 and 544 allow the first body portion 502 to be easily inserted into and seated against a non-circular portion of the non-circular segment 3224. The features of the first body portion 502 also facilitate this positioning and installation. More specifically, moving from the exterior surface 510 to the interior surface 506, the first body portion 502 includes a closure section 530 and a seating section 538. That is, the first body portion 502 includes a closure section 530 adjacent, or at least proximate, to the exterior surface 510 and a seating section 538 adjacent, or at least proximate, to the interior surface 506. The seating section 538 extends radially beyond the seating section 538 and, thus, defines a shoulder 536 between the closure section 530 and the seating section 538. Shoulder 536 can engage (e.g. sit on) a seat of the non-circular segment 3224 to secure, or at least orient/align, the first body portion 502 within the non-circular segment 3224.

In the depicted embodiment, the closure section 530 has a radial surface 532 that has a non-circular cross-sectional shape. Similarly, the seating section 538 has a radial surface 539 that has a non-circular cross-sectional shape. In fact, the radial surface 539 of the seating section 538 and the radial surface 532 of the closure section 530 have non-circular cross-sectional shapes that are substantially the same. That is, the closure section 530 has a first non-circular cross-sectional shape and the seating section 538 has a second non-circular cross-sectional shape that is smaller than, but similarly proportioned to, the first non-circular cross-sectional shape. Consequently, the closure section 530 and the seating section 538 define a shoulder 536 with a face 537 of substantially constant width and of substantially the same shape as the radial surface 539 and the radial surface 532. In the depicted embodiment, the non-circular shape of these various sections or features is a stadium or elongated oval, insofar as "elongated oval" or variations thereof, such as "elongated ovular shape," are used to denote a shape formed from two semi-circular lines connected by straight lines. However, this is just an example and other non-circular shapes, including one or more ellipses, can be used to achieve a non-circular shape.

In fact, all of the depicted shaping and dimensioning is provided as an example and other embodiments need not have such dimensions and/or shaping. Instead, the first body portion 502, and the sealing assembly 500 overall, should have dimensions and shaping that correspond with the dimensions and shaping of the non-circular segment 3224. For example, in some embodiments, the seating section 538 might have a non-circular shape and the closure section 530 might have a different non-circular shape or even a circular shape. In fact, in some embodiments, it may be advantageous to have a circular closure section 530. This is because machining non-circular shapes may be more difficult to machine than circular shapes. When the first body portion 502 includes a circular closure section 530, the non-circular segment 3224 may also include a corresponding circular section. Consequently, a circular closure section 530 may decrease the amount of complex machining required to manufacture the first body portion 502 and non-circular segment 3224, which may lower the costs associated with manufacturing the fluid end 104 and the sealing assembly 500 presented herein.

However, to preserve the advantages of the non-circular overall shape of the sealing assembly 500, when the closure section 530 has a circular shape or a non-circular shape that differs from the non-circular shape of the seating section 538, the overall dimensions of the closure section 530 should not extend beyond the narrow overall dimension 544 of the first body portion 502. Any extension beyond the narrow overall dimension 544 might restrict or prevent the first body portion 502 from being installed in the non-circular segment 3224. In any case, if only one of the closure section 530 and the seating section 538 includes a non-circular cross-sectional shape, the shoulder 536 may have a different shape than both of these sections. This is because an inner boundary of the shoulder 536 is defined by the closure section 530 and the outer boundary of the shoulder 536 is defined by the seating section 538.

Still referring to FIGS. 10A and 10B, in this embodiment, the sealing assembly 500 includes a second body portion 570 that is coupled directed to the exterior surface 510 of the first body portion 502 and inserted into the non-circular segment 3224 with the first body portion 502 or subsequent to installation of the first body portion 502. Either way, in this embodiment, the second body portion 570, is configured to be disposed entirely within the non-circular segment 3224 of the casing 206 of the fluid end 104' to fully install the first body portion 502 within the non-circular segment 3224 and substantially close the non-circular segment 3224. Accordingly, the exterior surface 510 includes a variety of features to securely mount and couple the second body portion 570 to the first body portion 502.

For example, the exterior surface 510 may include a central protrusion 514 that extends away from the exterior surface 510 and defines a bore 516. The exterior surface 510 may also include a plurality of receivers 512 (e.g., bores) that surround the protrusion 514. Correspondingly, the second body portion 570, which extends from an interior surface 574 to an exterior surface 576, defines bores 578 configured to align with the receivers 512 and a central bore 579 that aligns with the protrusion 514. As can be seen, the bores 578 of the depicted embodiment are countersunk to minimize the distance that couplers 595 installed therein extend beyond the exterior surface 576. Meanwhile, the central bore 579 can sit on the protrusion 514 of the first body portion 502 to center the second body portion 570 on the exterior surface 510 of the first body portion 502 while the couplers 595 are installed through bores 578 and into receivers 512.

Still referring to FIGS. 10A and 10B, but now with an emphasis on FIG. 10, perhaps the most important aspect of the second body portion 570 is that the interior surface 574 of the second body portion 570 bounds a channel 534 defined by the closure section 530 when the second body portion 570 is installed on the first body portion 502. More specifically, in the depicted embodiment, when the second body portion 570 is coupled to the first body portion 502, the seating section 538 defines an upstream wall of a channel 534 and the interior surface 574 of the second body portion 570 provides a downstream wall for channel 534. Thus, coupling the second body portion 570 to the first body portion 502 may retain or secure a seal element 320 (e.g., one or more seals and one or more seal carriers) within channel 534, as is shown best in FIG. 10. To be clear, any description of seal element 320 included in this application (e.g., the description above) should also be understood to apply to the embodiment of FIGS. 10A and 10B.

Moreover, to reiterate, while FIGS. 10A and 10B depict a non-circular closure assembly 500 as a plug-style closure assembly, the same principles, structures, and/or features may also be applicable to a sleeve-style/type closure element and could be used to close and/or seal other non-circular segments of a fluid end, such as a non-circular version of segment 2226. That is, although not shown herein, a sleeve-style, non-circular sealing assembly 500 may extend between casing 206 and a packing arrangement. Thus, in some instances, non-circular sealing assembly 500 disposed in segment 2226 may be referred to as a packing sleeve.

Figure 11:
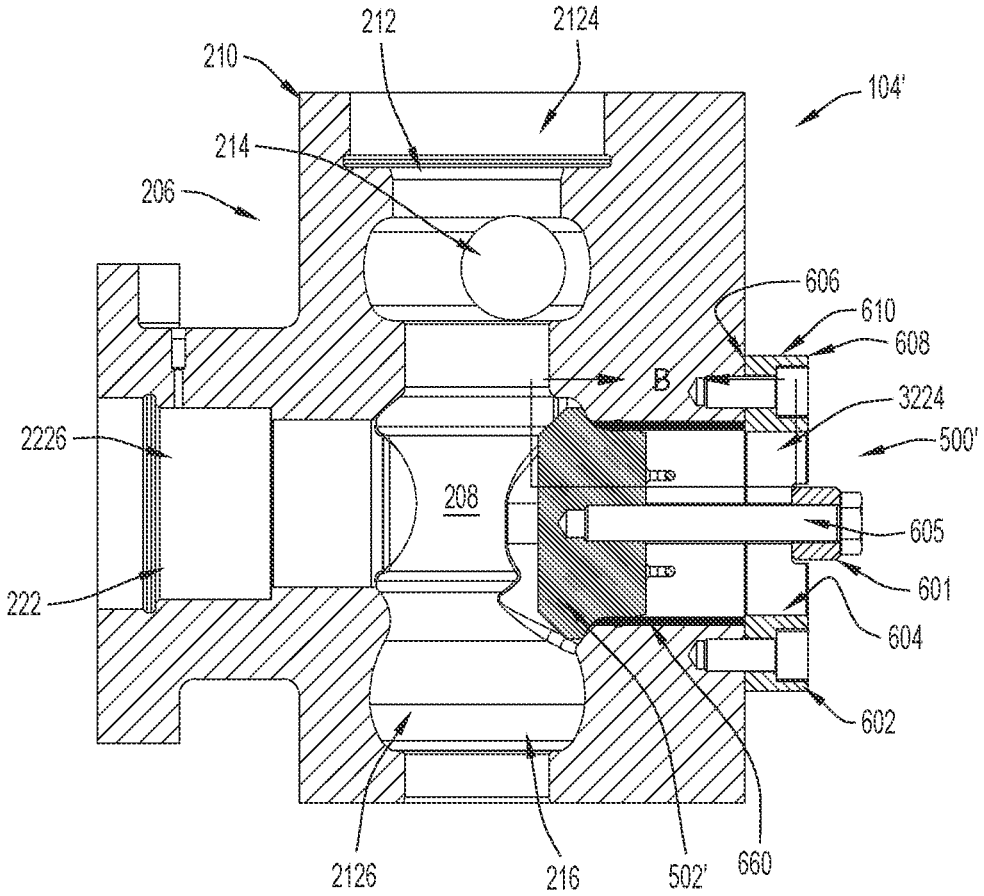
FIG. 11 is a schematic illustration of a sectional view of an example embodiment of a fluid end with still another example embodiment of a sealing assembly formed in accordance with the present application installed therein.
Figure 12:
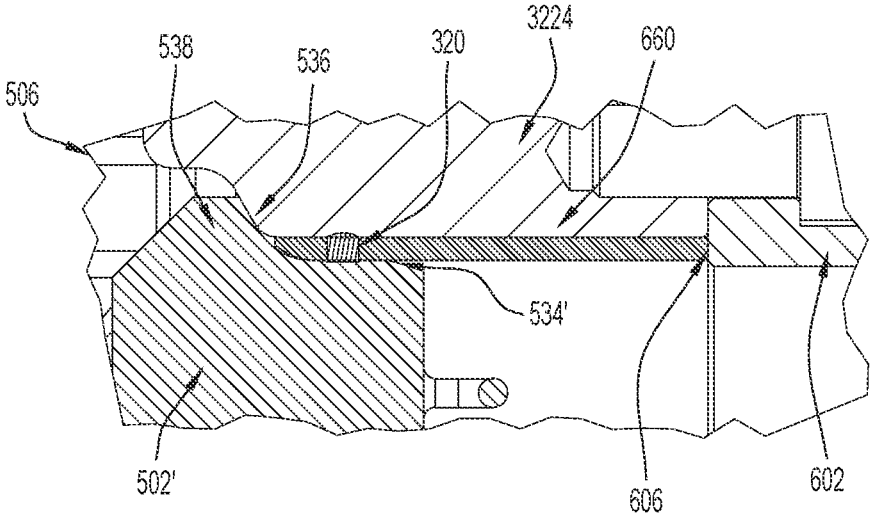
FIG. 12 is a close-up view of inset B of FIG. 11.

FIGS. 11 and 12 depict an embodiment that is similar to the embodiment of FIGS. 10A and 10B; however, now, sealing assembly 500' is a one-piece closure element. That is, the sealing assembly 500' now includes a first body portion 502', which is a modified version of first body portion 502', but does not include second body portion 570. Instead, the sealing assembly 500' includes a retaining assembly with a crossbar 601 and extended coupler 605 that are supported by an annular ring 602 on the external surface 210 of the casing 206 (i.e., disposed exteriorly of casing 206). The annular ring 602 extends from an interior surface 606 to an exterior surface 608. The interior surface 606 abuts the external surface 210 of casing 206 when the annular ring 602 is installed thereon. Additionally, the annular ring 602 extends from an internal surface 604 that surrounds and/or defines the exterior opening of the non-circular segment 3224 to an external surface 610.

In the depicted embodiment, both the internal surface 604 and the external surface 610 are non-circular. However, in other embodiments, the annular ring 602 need not include a non-circular internal surface 604 and a non-circular external surface 610. For example, the external surface 610 might be circular or the annular ring 602 might have any desirable shape that can secure the crossbar 601 to the external surface 210. The key is that the internal surface 604 extends at least partially over/within the exterior opening of the non-circular segment 3224 so that the interior surface 606 can define a shoulder at a proximal end of the non-circular segment 3224. In the embodiment depicted in FIGS. 11 and 12, the non-circular segment 3224 has substantially constant dimensions (e.g., a single non-circular shape) and, thus, the interior surface 606 may be sized based off a single non-circular shape. However, this non-circular segment 3224 is merely an example provided for simplicity and, in other embodiments, the annular ring 602 can be used with any desirable non-circular segment. For example, in other embodiments, the annular ring 602 may be sized to mate with, and extend partially over, a proximal end of an access section of a non-circular bore.

Additionally, in the embodiment of FIGS. 11 and 12 the sealing assembly 500' includes a first body portion 502' that does not include a fully bounded seal channel (e.g., like channel 534 of FIGS. 10A and 10B). Instead, first body portion 502' defines a channel 534' that is defined by the closure section 530, bounded on an upstream side by the seating section 538, and open on a downstream side. Then, as can be seen best in FIG. 12, an extended seal carrier 660 extends between the interior surface 606 of the annular ring 602 and the shoulder 536 of the first body portion 502' to support a seal element 320 between the first body portion 502' and the non-circular segment 3224. To be clear, any description of seal element 320 included in this application (e.g., the description above) should also be understood to apply to the embodiment of FIGS. 11 and 12. Moreover, in at least some instances, extended seal carrier 660 may be considered to be part of seal element 320. For example, extended seal carrier 660 may be a packing ring or another such seal carrier configured to support a seal, such as seal ring 321.

Figure 13:
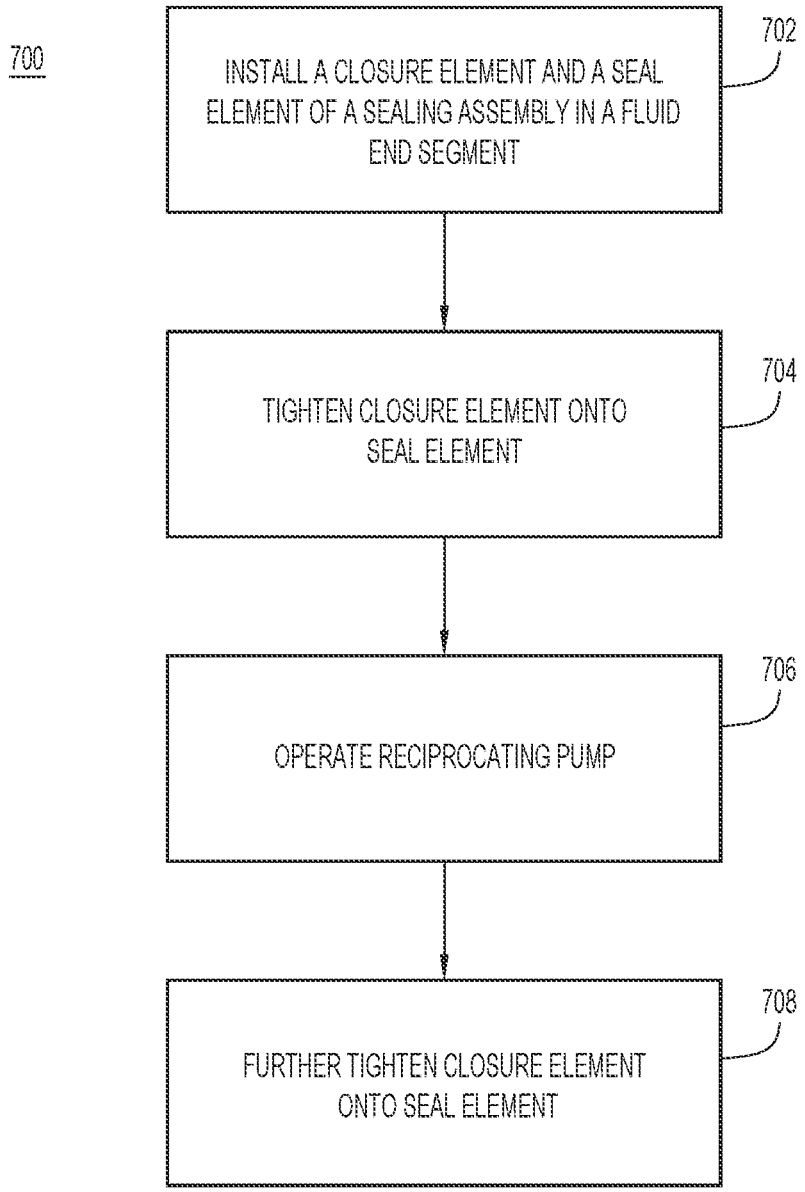
FIG. 13 is a flowchart depicting a method for sealing a segment of a fluid end of a high pressure reciprocating pump with the sealing assembly presented herein.

Now turning to FIG. 13, this Figure depicts a flowchart 700 illustrating a method of sealing a segment of a fluid end of a high pressure reciprocating pump with the sealing assembly presented herein. Initially, at step 702, a sealing assembly is installed in a fluid end segment. As is described above, a sealing assembly may include a closure element and a seal element, each of which may be formed from one or multiple pieces. Thus, installing the sealing assembly into a fluid end segment may involve multiple sub-steps, which may allow the seal element to be installed without frictional resistance that is generally experienced during installation of a closure element with biased and/or non-compressible seals (e.g., conventional rubber seals). Consequently, the sealing assembly presented herein may be much easier and quicker to install in (or remove from) a fluid end segment.

In one example, installation may involve: (1) inserting a first body portion into the fluid end segment; (2) inserting the seal element (in one or more steps, e.g., if the seal element comprises multiple packing rings) into the fluid end segment; and (3) inserting a second body portion into the fluid end segment to sandwich the seal element between the two body portions. Alternatively, step 702 may involve: (1) inserting a seal element into a fluid end segment; and (2) inserting a closure element into the fluid end segment. Still further, a sealing assembly might be assembled outside of a fluid end and then inserted into the fluid end in one or more steps (e.g., insertion may require specific orientations and rotations that might each be considered a step, e.g., for non-circular sealing assemblies). With the last example, the seal may remain in an uncompressed state during assembly of the sealing assembly and during insertion of the sealing assembly into the fluid end segment. Thus, the last example may still realize the low-friction installation advantages discussed above.

Moreover, in any case, after components of a sealing assembly are inserted into a fluid end segment, the installation of step 702 may further include securing the sealing assembly in the fluid end segment. For example, a retaining element might be threadably coupled to fluid end threads and/or bolted to the fluid end to secure a closure element in a fluid end segment. Alternatively, the sealing assembly may secure itself in a fluid end segment (e.g., after rotation of a non-circular fluid end), be retained by a cross bar, and/or secured/retained in any other desirable manner. In at least some instances, the components of a sealing assembly may also be secured to each other during step 702. For example, when the closure element is a two-piece closure element, one or more bolts (or any other fastener(s)) might be hand tightened to preassemble two body portions and a seal element.

After, the sealing assembly is installed into a fluid segment, the closure element is, at step 704, tightened, under the control of an end user, against the seal element to compress and energize a compressible seal included in the seal element. For example, when the closure element is a two-piece closure element, one or more bolts (or any other fastener(s)) may be torqued to tighten a second body portion against a first body portion and energize a compressible seal included in the seal element, creating a fluid-tight plug (or sleeve). Additionally or alternatively, a retaining ring might be installed over a closure element (e.g., a one-piece closure element) to tighten the closure element against the seal element and energize a compressible seal included in the seal element, creating a fluid-tight plug (or sleeve).

In at least some embodiments, the sealing assembly may include one or more anti-rotation elements (e.g., pins) to prevent, or at least resist, rotation during this tightening. For example, an anti-rotation element (e.g., a pin and/or notch) may be disposed between two body portions of a multi-piece closure element to discourage or prevent rotation of one body portion with respect to the other. Additionally or alternatively, an anti-rotation element (e.g., a pin and/or notch) may be disposed between the fluid end and the closure element to discourage or prevent the closure element from rotating within a fluid end segment during tightening.

Once the closure element is tightened to create a fluid-tight plug or sleeve, the reciprocating pump operates, at step 706, positively displacing fluid in the manner described above, e.g., in connection with FIGS. 1 and 2. Over time, these operations will cause the seal of the seal element to wear. Thus, after some time (e.g., after a predetermined time or until wear is observed), the closure element can be further tightened onto the seal element, at step 708. The tightening may be achieved in the same manner as at step 704, except now, further tightening re-energizes the compressible seal of the seal element. That is, the closure element may be further tightened against the seal element to compensate for wear experienced over time. This results in longer seal performance. Put another way, since the seal can be re-tightened and re-energized, the sealing assembly may have an extended lifespan as compared to sealing arrangements utilizing non-compressible seals (e.g., conventional rubber seals). Additionally, since the compressible seal material is less flexible compared to non-compressible seals (e.g., standard rubber seals), the seal will move less and experience less movement-generated abrasion.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims. It is also to be understood that, unless otherwise stated, the sealing assembly described herein, or portions thereof may be fabricated from any materials commonly used for closure elements and/or seals.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

The invention claimed is:

1. A sealing assembly for a fluid end of a reciprocating pump, the sealing assembly being installable within a segment of a casing of the fluid end and being arranged to form a seal with the segment, the sealing assembly comprising:

a closure element with a sealing portion, the sealing portion having a lateral surface that faces an interior wall of the segment; and a seal element extending axially from an annular outer surface to an annular inner surface, the seal element comprising:

a seal installed on and around the lateral surface, the seal being configured to form a seal between the lateral surface of the closure element and the interior wall of the segment; and one or more seal carriers installed on and around the lateral surface, the one or more seal carriers configured to position the seal with respect to the closure element, wherein the closure element comprises a first body portion, a second body portion, and a bolt that removably secures the first body portion to the second body portion, and when the sealing assembly is fully assembled, the first body portion is configured to contact the annular outer surface along its entire circumference and the second body portion is configured to contact the annular inner surface along its entire circumference.

2. The sealing assembly of claim 1, wherein the seal is a compressible seal.

3. The sealing assembly of claim 1, wherein the lateral surface is a grooveless surface.

4. The sealing assembly of claim 1, wherein the seal and the one or more seal carriers comprise packing rings.

5. The sealing assembly of claim 1, wherein the first body portion and the second body portion collectively define a main body that extends from an interior surface to an exterior surface, wherein at least a portion of the main body has a non-circular cross-sectional shape.

6. The sealing assembly of claim 1, wherein the seal is a compressible seal and the bolt is operable to compress and energize the compressible seal, both during an initial installation and to compensate for wear over time.

7. The sealing assembly of claim 1, wherein the closure element further comprises:

one or more anti-rotation elements that prevent rotation of the first body portion with respect to the second body portion.

8. The sealing assembly of claim 1, wherein the lateral surface is defined by the first body portion and a retaining surface of the second body portion sandwiches the seal element against a shoulder of the first body portion.

9. The sealing assembly of claim 1, wherein the lateral surface is defined by the second body portion and a retaining surface of the first body portion sandwiches the seal element against a shoulder of the second body portion.

10. The sealing assembly of claim 9, wherein the retaining surface of the first body portion and the shoulder define an axially extending pocket.

11. The sealing assembly of claim 1, wherein the first body portion includes a cavity, the second body portion includes a protrusion that extends into the cavity, and one or more seals are disposed between the protrusion and the cavity.

12. A sealing assembly for a fluid end of a reciprocating pump, the sealing assembly being installable within a segment of a casing of the fluid end and being arranged to form a seal with the segment, the sealing assembly comprising: a closure element with a sealing portion, the sealing portion having a lateral surface that faces an interior wall of the segment; and a seal element extending axially from an annular outer surface to an annular inner surface, the seal element comprising: a seal installed on and around the lateral surface, the seal being configured to form a seal between the lateral surface of the closure element and the interior wall of the segment; and one or more seal carriers installed on and around the lateral surface, the one or more seal carriers configured to position the seal with respect to the closure element, wherein the closure element comprises a first body portion with a cavity and a second body portion with a protrusion, and when the sealing assembly is fully assembled, the protrusion extends into the cavity, one or more seals are disposed between the protrusion and the cavity, the first body portion is configured to contact the annular outer surface along its entire circumference, and the second body portion is configured to contact the annular inner surface along its entire circumference.

13. The sealing assembly of claim 12, wherein the seal is a compressible seal.

14. The sealing assembly of claim 12, wherein the lateral surface is a grooveless surface.

15. The sealing assembly of claim 12, wherein the seal and the one or more seal carriers comprise packing rings.

16. The sealing assembly of claim 12, wherein the first body portion and the second body portion collectively define a main body that extends from an interior surface to an exterior surface, wherein at least a portion of the main body has a non-circular cross-sectional shape.

17. The sealing assembly of claim 12, wherein the seal is a compressible seal and the closure element further comprises:

a bolt that removably secures the first body portion to the second body portion, the bolt being operable to compress and energize the compressible seal, both during an initial installation and to compensate for wear over time.

18. The sealing assembly of claim 12, wherein the closure element further comprises:

one or more anti-rotation elements that prevent rotation of the first body portion with respect to the second body portion.

19. The sealing assembly of claim 12, wherein the lateral surface is defined by the first body portion and a retaining surface of the second body portion sandwiches the seal element against a shoulder of the first body portion.

20. The sealing assembly of claim 12, wherein the lateral surface is defined by the second body portion and wherein a retaining surface of the first body portion sandwiches the seal element against a shoulder of the second body portion, the retaining surface of the first body portion and the shoulder of the second body portion define an axially extending pocket, or both.

* * * * *